US008191673B1

(12) United States Patent
Peaslee

(10) Patent No.: US 8,191,673 B1
(45) Date of Patent: Jun. 5, 2012

(54) COLLAPSIBLE MEGAPHONE DEVICE

(76) Inventor: Scott Peaslee, Somerset, CA (US)

( * ) Notice: Subject to any disclaimer, the term of this patent is extended or adjusted under 35 U.S.C. 154(b) by 0 days.

(21) Appl. No.: 12/963,436

(22) Filed: Dec. 8, 2010

(51) Int. Cl.
*G10K 11/08* (2006.01)

(52) U.S. Cl. ..... 181/178

(58) Field of Classification Search ..... 181/177, 181/178, 180
See application file for complete search history.

(56) References Cited

U.S. PATENT DOCUMENTS

| | | | | | |
|---|---|---|---|---|---|
| 648,994 | A | * | 5/1900 | Poirter | 181/178 |
| 673,396 | A | * | 5/1901 | Hogan | 181/178 |
| 763,808 | A | * | 6/1904 | Sturges | 181/178 |
| 786,395 | A | * | 4/1905 | Zellers | 181/178 |
| 936,910 | A | * | 10/1909 | Kingsley | 181/178 |
| 1,158,871 | A | * | 11/1915 | Tomlin | 138/166 |
| 1,504,170 | A | * | 8/1924 | Weins | 181/178 |
| 1,613,001 | A | * | 1/1927 | Wilhelm | 181/178 |
| 2,012,538 | A | * | 8/1935 | Krohn | 181/178 |
| 2,507,843 | A | * | 5/1950 | Wheeler | 229/402 |
| 2,517,665 | A | * | 8/1950 | Hochstein | 181/178 |
| 2,810,446 | A | * | 10/1957 | Hooe | 181/178 |
| 4,613,012 | A | * | 9/1986 | Mueller, III | 181/178 |
| 4,703,829 | A | * | 11/1987 | Hardt | 181/178 |
| 5,094,317 | A | * | 3/1992 | Ladendorf | 181/178 |
| 5,501,363 | A | * | 3/1996 | Muller et al. | 220/630 |
| 5,631,450 | A | | 5/1997 | Itakura | |
| 5,675,133 | A | | 10/1997 | Kobayashi | |
| 5,967,875 | A | * | 10/1999 | Graef | 446/74 |
| 6,837,334 | B1 | | 1/2005 | Le Prevost | |
| 6,889,797 | B2 | * | 5/2005 | Cowgill et al. | 181/178 |
| D559,830 | S | | 1/2008 | Lintern | |
| 2009/0114474 | A1 | * | 5/2009 | Morgan | 181/178 |
| 2010/0193281 | A1 | | 8/2010 | Roberson | |

FOREIGN PATENT DOCUMENTS

FR 2777108 A1 * 10/1999

* cited by examiner

*Primary Examiner* — Jeremy Luks
(74) *Attorney, Agent, or Firm* — Bay Area Technology Law Group PC

(57) ABSTRACT

A collapsible megaphone device having a body portion capable of lying flat in a first state and capable of assuming the shape of a megaphone in a second state where in the first state, the collapsible megaphone device is substantially two dimensional and planar having a first edge, second edge and boundary edges joining the first and second edges. The collapsible megaphone device is convertible from the first state to the second state by exerting pressure against its boundary edges and is returnable to the first state by removing pressure from its boundary edges.

7 Claims, 2 Drawing Sheets

COLLAPSIBLE MEGAPHONE DEVICE

TECHNICAL FIELD

The present invention involves a collapsible megaphone device which, in its collapsed state, is two dimensional and capable of laying flat against a user's chest through the use of a lanyard which is connected to the device and sized to fit around a user's neck. By applying pressure to the boundary edges of the planar two dimensional body of the collapsible megaphone device, a three dimensional megaphone is created.

BACKGROUND OF THE INVENTION

Megaphones have been used for quite some time both as functional devices in the workplace as well as recreational devices employed in such venues as sporting events and the like. Acoustically, a megaphone, generally shaped as the frustum of a cone, is capable of acoustically amplifying a user 's voice which can have significant practical benefits. In the workplace, a foreman or other worker wishing to project a command over a long distance above background ambient noise, might employ a megaphone for that purpose. Not only the human voice but also signals, whistles and tones can be amplified by using such a device in order to signal commands to others.

When attending a sporting event, such as a football game, supporting a favorite team, disparaging its opposition and expressing pleasure or displeasure over a referee's call can all benefit from the use of a megaphone. However, both in the workplace as well as at sporting venues, many potential users of megaphones decide to forego using them simply because megaphones are large and bulky and are simply too difficult to cope with as a result.

In addition, as more and more products are produced offshore and generally in Asian countries, the cost of transporting manufactured products can represent a substantial component of the overall cost of goods. Providing a product which can be shipped in a planar, two dimensional state to enable a shipper to maximize packing density is certainly desirable resulting in an overall improvement in manufacturing economy.

Finally, whether at a sporting event, workplace or virtually any other venue excessive temperatures particularly in the summer months, oftentimes necessitate the need for a fan. Thus, a goal in conceiving of the present invention is to provide a device which could not only be used as a megaphone, but also, because of its two dimensional collapsible orientation, can be grasped by a user and employed as a fan-like device.

It is thus an object of the present invention to provide a collapsible megaphone device which, when not used, can assume a planar two dimensional orientation convertible to a three dimensional megaphone device at will while returning, once again to its planar configuration at the whim of a user.

It is yet a further object of the present invention to provide a collapsible megaphone device which, when not in use, is capable of hanging from a user's neck and against a user's chest only to be converted into a megaphone by simply applying pressure to its edges and without the need to construct the megaphone each time it is to be employed.

These and further objects will be more readily apparent when considering the following disclosure and appended claims.

SUMMARY OF THE INVENTION

A collapsible megaphone device having a body portion capable of lying flat in a first state and capable of assuming the shape of a megaphone in a second state where in the first state, the collapsible megaphone device is substantially two dimensional and planar having a first edge, second edge and boundary edges joining the first and second edges. The collapsible megaphone device is convertible from the first state to the second state by exerting pressure against its boundary edges and is returnable to the first state by removing pressure from its boundary edges.

DETAILED DESCRIPTION OF THE INVENTION

Figure 1:
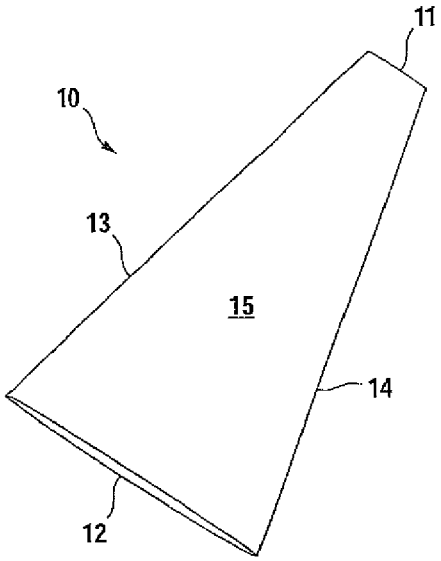
FIG. 1 is a perspective view of the collapsible megaphone device of the present invention in its first state.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

In reference to FIG. 1, collapsible megaphone device 10 is shown having body portion 15. FIG. 1 depicts megaphone device 10 in a first state noting that in this state, the device is substantially two dimensional and planar.

Body portion 15 is defined by first edge 11, second edge 12 and boundary edges 13 and 14. In use, first edge 11 defines the mouthpiece portion of the megaphone device while edge 12 defines its expanded portion creating interior volume 16 when in use.

In its first or collapsed state, megaphone device 22 (FIG. 3) can receive lanyard 23 connected to the body portion of collapsible megaphone device 22 attachable thereto by clip or loop 24 as shown. Lanyard 23 is sized to fit about the neck of user 21 such that the body portion of megaphone 22 would lie proximate the chest of user 21 as shown. Suitable indicia 25 can be applied to the body portion of collapsible megaphone device 22 to be visible when the device is worn by a user when lanyard 23 is appended to the device proximate first edge 26. Thus, a user can promote one's favorite team, college or university. Advertisers can promote their goods while businesses can place their names and addresses on the body portion of collapsible megaphone 22 in order to associate it with a company, team or product as desired This would obviously provide both advertising opportunities as well as ownership to the collapsible megaphone device when appropriate.

Figure 2:
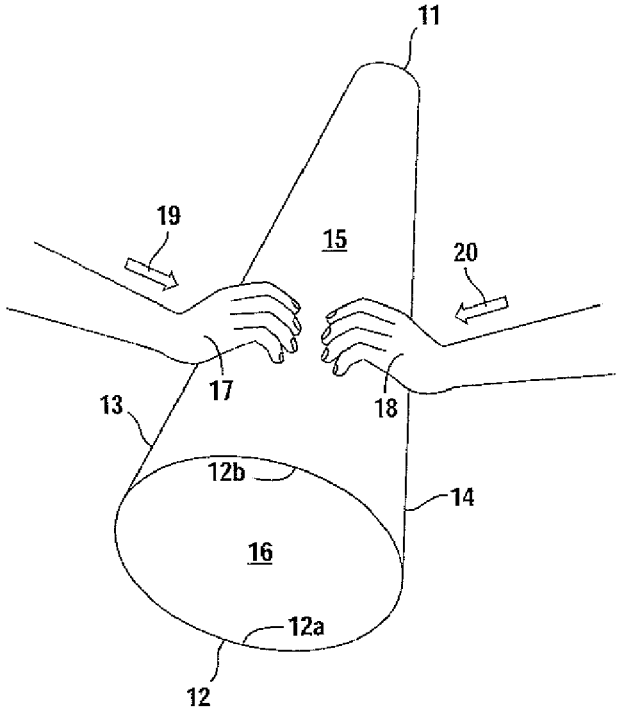
FIG. 2 is a perspective view of the collapsible megaphone device of the present invention in its second state.
Figure 3:
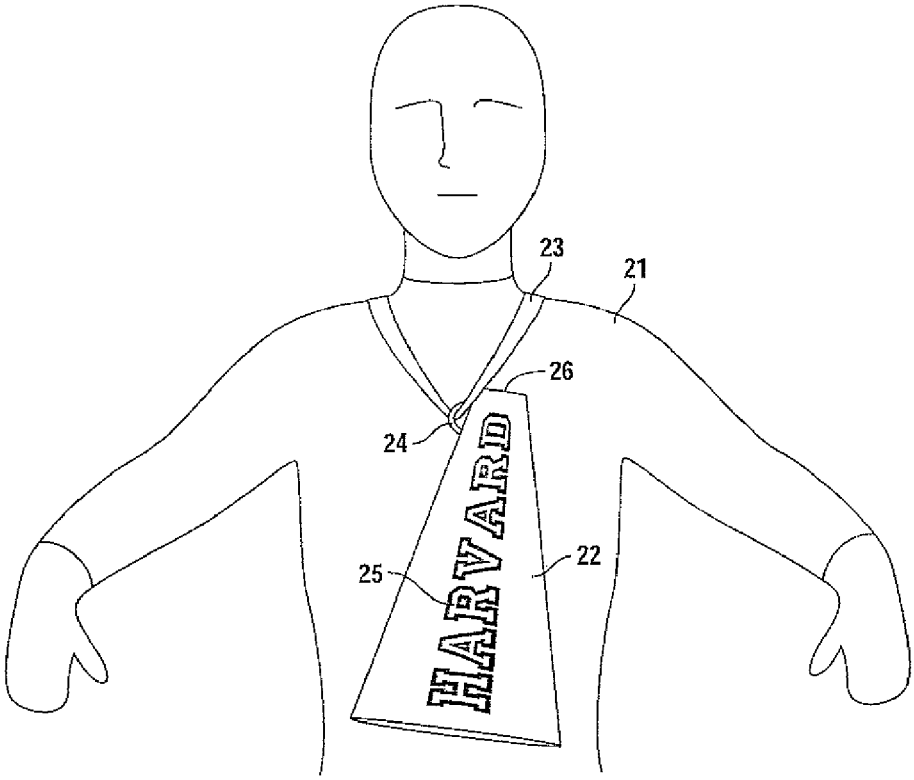
FIG. 3 is a front view of the collapsible megaphone device in its first state supported by a lanyard around a user's neck.
Figure 4:
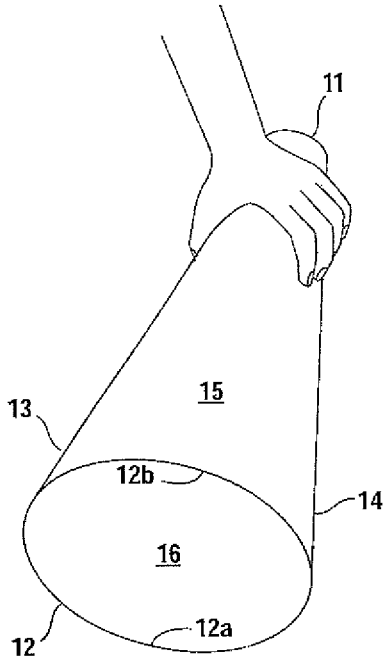
FIG. 4 is a perspective view of the collapsible megaphone device of the present invention in its second state, similar to that shown in FIG. 2 whereby the second or expanded state is achieved through the use of a single hand of a user.

In converting the collapsible megaphone device from its first state shown in FIGS. 1 and 3 to its usable second state, reference is made to FIGS. 2 and 4.

In creating a usable megaphone, hands 17 and 18 of a user would simply exert pressure against boundary edges 13 and 14 in the direction of arrows 19 and 20. This would cause edges 12*a* and 12*b* to move away from one another creating internal volume 16 as shown. In creating a suitable megaphone device, it is quite apparent that one need not construct any subparts or in any way engage in the process of constructing or destructing a usable megaphone. Instead, one need only exert pressure on the boundary edges of the planar device to convert it from its first planar state to its second three dimensional state. Similarly, a user need only remove pressure from boundary edges 13 and 14 and megaphone device 10 will then convert back to its planar (FIG. 1) orientation. It should further be appreciated, in reference to FIG. 4, that boundary edges 13 and 14 can be moved towards one another to create the present three dimensional megaphone device with internal open space 16 through the use of a single hand whereby, as shown in FIG. 4, the thumb of a user is pressed against boundary edge 13 while the user's fingers are pressed against boundary edge 14. This is generally conveniently accomplished proximate first edge 11 as that is the portion of the device which is at its narrowest enabling a user to grip the device with a single hand as shown.

Ideally, the present invention is to be constructed of paper stock or a plastic sheeting such as polypropylene and polyethylene sheeting which can be die cut, scored, welded or heat sealed. Materials are selected such that collapsible megaphone 10 will retain its collapsed orientation once pressure is removed from its boundary edges.

As noted previously, the present invention can also be used for other purposes. In this regard, reference is made to FIG. 5.

Figure 5:
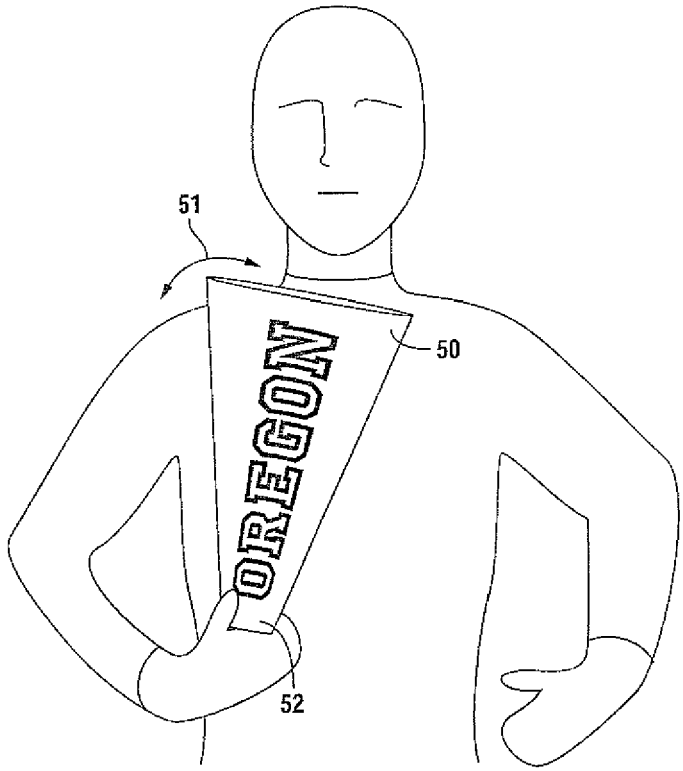
FIG. 5 is a front view of the present invention showing the collapsible megaphone device being employed as a fan.

Turning to FIG. 5, as shown, megaphone 50 can be grasped at or near first edge 52 or, for that matter, at any point along the megaphone surface and when moved in the directions of arrows 51, can be employed as a fan. The unique nature of the present invention, that is, its ability to assume a planar orientation when collapsed, makes it an ideal fan for those attending a sporting event and the like during the summer months when temperatures can be excessive and humidity high.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like.

Therefore, the above description and illustration should not be considered as limiting the scope of the invention, which is defined by the appended claims.

What is claimed is:

1. A collapsible megaphone device having a body portion with a flat configuration in a first state and capable of assuming the three dimensional shape of a megaphone in the second state, wherein in said first state, said collapsible megaphone device is substantially two dimensional and planar having a first edge, second edge and boundary edges joining said first and second edges, said collapsible megaphone device being convertible between said first state and said second state, wherein said megaphone device is biased towards said first state so that said megaphone device assumes said second state as long as inward pressure is exerted against its boundary edges and automatically returns to said first state when said inward pressure is removed from said boundary edges.

2. The collapsible megaphone device of claim 1 further comprising a lanyard connected to said body portion sized to fit around a user's neck.

3. The collapsible megaphone device of claim 2 wherein said lanyard is sized such that when worn, said body portion lies proximate the chest of a user.

4. The collapsible megaphone device of claim 2 wherein said lanyard is attached to said body portion proximate said first edge.

5. The collapsible megaphone device of claim 3 further comprising indicia applied to said body portion and visible when said collapsible megaphone device is worn by a user.

6. The collapsible megaphone device of claim 1 wherein said body portion comprises paper stock.

7. The collapsible megaphone device of claim 1 wherein said body portion comprises a member selected from the group consisting of polypropylene and polyethylene sheeting.

* * * * *